United States Patent [19]

Marin

[11] Patent Number: 4,518,481

[45] Date of Patent: May 21, 1985

[54] PROCESS FOR PRODUCTION OF OXIDATION-RESISTANT HYDROCARBON OIL COMPOSITION, AND OXIDATION-RESISTANT COMPOSITION MADE THEREBY

[75] Inventor: Pierre D. Marin, Bonsecours, France

[73] Assignee: Exxon Research & Engineering Company, Florham Park, N.J.

[21] Appl. No.: 522,046

[22] Filed: Aug. 10, 1983

Related U.S. Application Data

[63] Continuation of Ser. No. 272,926, Jun. 12, 1981, abandoned.

[30] Foreign Application Priority Data

Jun. 17, 1980 [GB] United Kingdom ..... 8019728

[51] Int. Cl.[3] ..... C10G 71/00; C10G 45/44

[52] U.S. Cl. ..... 208/19; 208/213; 585/13

[58] Field of Search ..... 208/19, 213; 585/13

[56] References Cited

U.S. PATENT DOCUMENTS

| | | | |
|---|---|---|---|
| 3,252,887 | 5/1966 | Rizzuti | 208/19 |
| 3,520,796 | 7/1970 | Murphy et al. | 208/13 |
| 3,617,473 | 11/1971 | Lipscomb | 208/14 |
| 3,759,817 | 9/1973 | Mills et al. | 208/19 |
| 3,904,507 | 9/1975 | Mills | 208/19 |
| 4,069,165 | 1/1978 | Masunaga et al. | 208/19 |
| 4,069,166 | 1/1978 | Masunaga et al. | 208/19 |
| 4,385,984 | 5/1981 | Bijwaard et al. | 208/19 |

FOREIGN PATENT DOCUMENTS 1572794 8/1980 United Kingdom .

*Primary Examiner*—Delbert E. Gantz
*Assistant Examiner*—Helane Myers
*Attorney, Agent, or Firm*—Eugene Zagarella

[57] ABSTRACT

An oxidation-resistant hydrocarbon oil composition is made by catalytically hydrogen-refining under relatively severe conditions a hydrocarbon oil basestock boiling in the lube oil boiling range and separately catalytically hydrogen-refining under relatively mild conditions a hydrocarbon fraction boiling in the lube oil range and having an aniline point exceeding 60° C. and a sulfur content of at least 2.0 wt %. The resulting severely-refined basestock has a sulfur content not greater than 0.10 wt % and the resulting mildly-refined fraction has a sulfur content of at least 1.0 wt %, and the desired oxidation resistant composition is a blend comprising 85 to 99.9 wt % of the former and 15 to 0.1 wt % of the latter.

12 Claims, No Drawings

PROCESS FOR PRODUCTION OF OXIDATION-RESISTANT HYDROCARBON OIL COMPOSITION, AND OXIDATION-RESISTANT COMPOSITION MADE THEREBY

This is a continuation of application Ser. No. 272,926, filed June 12, 1981, now abandoned.

The present invention relates to a process for the production of an oxidation-resistant hydrocarbon oil composition and to an oxidation-resistant composition made thereby.

It is a common requirement that hydrocarbon oil compositions should be stable, particularly to oxidation, and more particularly if their intended use extends over a relatively long period of time before they are discarded. If such intended use includes exposure to conditions which tend to promote the formation of undesirable by-products due to oxidation, there would clearly be advantages in employing for such use a hydrocarbon oil composition which has a high resistance to oxidation.

It is known that the stability of hydrocarbon oils, particularly with regard to oxidation, is improved by catalyzed hydrogen-refining under conditions which are sufficiently severe to remove those sulfur and oxygen moieties which tend to promote oxidative degradation of the hydrocarbon oils, but not so severe that other desirable characteristics are impaired. Catalyzed hydrogen-refining is well-known under the name "hydrofining" and will be herein referred to from time-to-time, as hydrofining for brevity.

Hydrofining is usually effected under such conditions that the sulfur content of the hydrofined hydrocarbon oil is reduced to a value in the range of from 0.1 to 0.3 wt % which heretofore has been accepted as providing optimum oxidation stability.

The process of the invention is based on the discovery that greater oxidation stability can be realised than hitherto by subjecting a hydrocarbon oil basestock to hydrofining under more severe conditions than previously practiced, and blending with the thus severely hydrofined basestock a hydrocarbon fraction which is relatively rich in aromatic compounds and sulfur and which has been subjected to very mild and selective hydrofining conditions.

According to the present invention, there is provided a process for producing a hydrocarbon oil composition of high resistance to oxidation comprising the steps of:

(a) subjecting a hydrocarbon oil basestock boiling in the lube oil temperature range to a catalytic hydrogen-refining treatment at a temperature in the range of from 300° to 360° C. and at a partial pressure of hydrogen in the range of from 20 to 50 bars to produce a refined basestock having a sulfur content not exceeding 0.10 wt %;

(b) subjecting a hydrocarbon fraction boiling in the lube oil temperature range and having an aniline point not exceeding 60° C. and a sulfur content of at least 2.0 wt.% to a catalytic hydrogen-refining treatment at a temperature in the range of from 220° to 300° C. and a partial pressure of hydrogen in the range of from 20 to 50 bars to produce a refined fraction having a sulfur content of at least 1.0 wt %; and (c) forming a blend comprising 85 to 99.9 wt % of the said refined basestock and 15 to 0.1 wt % of said refined fraction.

Preferably, the hydrogen partial pressure in step (a) is in the range of from 30 to 40 bars, and the catalytic hydrogen-refining treatment of step (a) may be performed at a LHSV in the range of from 0.3 to 2.0 $h^{-1}$.

Step (a) is preferably so effected as to produce a refined basestock having a sulfur content not exceeding 0.05 wt %.

Preferably, the hydrocarbon oil basestock has a specific gravity at 15° C. not exceeding 0.900, and preferably an aniline point exceeding 60° C.

The mineral oil basestock may be a raffinate obtained by solvent extraction of aromatics from a lube feedstock.

The hydrogen partial pressure in step (b) is preferably in the range of from 30 to 40 bars, and preferably the temperature in step (b) is in the range of from 240° to 280° C.

The hydrocarbon fraction may have an aniline point not exceeding 35° C. before the catalytic hydrogen-refining step.

The refined fraction produced by step (b) preferably has a sulfur content of at least 2.0 wt %.

Preferably, the hydrocarbon fraction has a sulfur content of at least 3.5 wt % before step (b) is effected.

Step (b) is preferably performed at a LHSV ($h^{-1}$) in the range of from 0.3 to 2.0 $h^{-1}$.

The catalyst employed in step (a) and step (b) may comprise a Group VI metal component and a non-noble Group VIII metal component.

Excellent products are obtained when the hydrocarbon fraction is an aromatics-rich hydrocarbon fraction obtained by thermal cracking (e.g. steam cracking) or catalytic cracking of a heavy hydrocarbon feedstock.

The invention further provides a hydrocarbon oil composition of high resistance to oxidation obtained by a process as described above. The stable hydrocarbon oil compositions of the invention are particularly, but by no other means exclusively, suitable for use as dielectric oils (e.g. in transformers) and as turbine oils, inter alia.

The invention will now be further described with reference to some non-limitative examples thereof.

EXAMPLE 1 (FOR COMPARISON)

A distillate lube fraction basestock L derived from a naphthenic crude oil was subjected to a solvent extraction operation to reduce its content of aromatic compounds, sulfur and nitrogen, all of which tend to reduce the stability of the fraction when exposed to oxygen-containing gas (e.g. air) in transformers and turbines.

The distillate lube basestock and the raffinate basestock A obtained therefrom after solvent extraction had the following characteristics.

| | lube basestock L | raffinate basestock A |
|---|---|---|
| Refractive Index (60°) | 1.484 | 1.462 |
| Specific Gravity (15° C.) | 0.897 | 0.864 |
| Sulfur (wt %) | 1.35 | 0.57 |
| Basic Nitrogen (ppm) | 140 | 54 |
| Aromatic carbon, $C_{AR}$ (% 1R) | — | 9.8 |

The raffinate basestock was hydrofined under conditions which are more severe than those commonly used to improve stability and other properties. The main features of the hydrofining step were as shown in Table I:

TABLE I

| Catalyst | Supported Ni and Mo (Catalyst X) |
|---|---|
| LHSV ($h^{-1}$) | 0.7 |
| $H_2$ pressure (bars) | 35 |
| $H_2$/Oil ratio (vol./vol.) | 100 |
| Temperature (°C.) | 320 |
| The hydrofined basestock B had the following main characteristics: | |
| Aromatic carbon, % (by IR) | 9.6 |
| Sulfur wt % | 0.05 |

The hydrofined basestock B was found to have very poor oxidation stability in a severe oxidation test, viz:

| Baader Test Characteristic | Hydrofined B | VDE* specification maximum |
|---|---|---|
| Saponification No (mg · KOH/g) | 9.6 | 0.6 |
| Sludge (wt. %) | 0.42 | 0.05 |
| Tan Δ at 90° C. (%) | 80 | 18 |

*VDE = Verbindung Deutsche Elektrotechnische, DIN 0370

EXAMPLE 2

An aromatic hydrocarbon fraction C is obtained during a fluidized catalytic cracking operation. The fraction C is subjected to a mild hydrofining treatment at a relatively low temperature which produces a hydrofinate C'. The hydrofining conditions and the main characteristics of C and C' are given in Table II.

TABLE II

| Characteristics | C | C' |
|---|---|---|
| Refractive Index at 60° C. | 1.587 | 1.572 |
| Specific Gravity at 15° C. | 1.007 | 0.989 |
| Aniline Point, °C. | 33 | 32 |
| Viscosity at 40° C. (cS) | 15.6 | 13.3 |
| Sulfur, wt % | 3.5 | 2.4 |
| Nitrogen (ppm) | 810 | 740 |
| Hydrofining Conditions | | |
| Catalyst | Supported Ni—Mo | |
| LHSV ($h^{-1}$) | 0.7 | |
| $H_2$ pressure (bars) | 30 | |
| $H_2$/Oil Ratio (vol./vol.) | 100 | |
| Temperature (°C.) | 240 | |

The hydrofinate C' was added at a number of different proportions to the hydrofinite B of Example 1 and the resulting compositions were examined for oxidation stability using the Baader test. The results appear in Table III:

TABLE III

| | Composition (wt %) | | | | | |
|---|---|---|---|---|---|---|
| B | 100 | 98 | 96 | 94 | 92 | |
| C' | 0 | 2 | 4 | 6 | 8 | |
| Sulfur | 0.05 | 0.10 | 0.14 | 0.18 | 0.23 | |
| | Baader Test | | | | | VDE Specs. (maximum) |
| Saponification No. | 9.6 | 5.2 | 3.1 | 1.3 | 0.25 | 0.6 |
| Sludge, wt % | 0.42 | 0.23 | 0.15 | 0.06 | 0.02 | 0.05 |
| Tan Δ at 90° C. (%) | 80 | 22 | 13 | 5.5 | 3 | 18 |

It is apparent from Table III that the addition of hydrofinate C' to hydrofinate B produced a composition of high oxidation stability which, within the limits shown in Table III, increased with an increased concentration of hydrofinate C'.

EXAMPLE 3

An aromatic hydrocarbon fraction D is obtained by distillation of a steam cracker tar. The fraction D is subjected to a mild hydrofining treatment at a relatively low temperature, and a hydrofinate D' is recovered. The principal characteristics of D and D' are given in Table IV, and the hydrofining conditions are the same as in Table III.

TABLE IV

| Characteristics | D | D' |
|---|---|---|
| Refractive Index at 60° C. | 1.631 | 1.615 |
| Specific Gravity at 15° C. | 1.060 | 1.051 |
| Aniline Point (°C.) | 14 | 9 |
| Viscosity at 40° C. (cS) | 8.7 | 7.4 |
| Sulfur, wt % | 5.0 | 4.0 |
| Nitrogen (ppm) | 820 | 750 |

The hydrofinate D' was added at a number of different proportions to the hydrofinate B of Example 1 and the resulting compositions were tested for oxidation stability by the Baader test. The results are given in Table V.

TABLE V

| | Composition, wt % | | | | | |
|---|---|---|---|---|---|---|
| B | 100 | 98 | 96 | 94 | 92 | |
| D' | 0 | 2 | 4 | 6 | 8 | |
| Sulfur | 0.05 | 0.12 | 0.21 | 0.28 | 0.37 | |
| | Baader Test | | | | | VDE Spec (maximum) |
| Saponification No. | 9.6 | 4.2 | 1.06 | 0.15 | 0.10 | 0.6 |
| Sludge (wt %) | 0.42 | 0.20 | 0.07 | 0.01 | 0.01 | 0.05 |
| Tan Δ at 90° C. (%) | 80 | 35 | 6.7 | 1.5 | 1.6 | 18 |

These results are similar to, but somewhat better than, excellent results apparent from the data in Example 2.

EXAMPLE 4

The raffinate basestock A of Example 1 was hydrofined under the same severe conditions of Table I except that a more efficient catalyst of supported Ni-Mo (Catalyst Y) was employed. The resulting hydrofinate E had the following main characteristics:

Aromatic Carbon, % (by IR): 9.4

Sulfur, wt %: 0.03

The hydrofinates C' (Example 2) and D' (Example 3) were separately added to hydrofinate E in different proportions to form different hydrocarbon compositions whose oxidation stability was again evaluated by the Baader Test. The results are given in Tables VI and VII.

TABLE VI

| | Composition, wt % | | | | | |
|---|---|---|---|---|---|---|
| E | 100 | 98 | 96 | 94 | 92 | |
| C' | 0 | 2 | 4 | 6 | 8 | |
| Sulfur | 0.03 | 0.08 | 0.12 | 0.17 | 0.22 | |
| | Baader test | | | | | VDE Specification (maximum) |
| Saponification No. | 8.8 | 4.8 | 0.17 | 0.12 | 0.06 | 0.6 |
| Sludge, wt % | 0.44 | 0.12 | 0.01 | 0.01 | 0.01 | 0.05 |
| Tan Δ at 90° C. (%) | 80 | 21 | 5.8 | 1.8 | 1.7 | 18 |

TABLE VII

| | Composition, wt % | | | | | |
|---|---|---|---|---|---|---|
| E | 100 | 98 | 96 | 94 | 92 | |
| D' | 0 | 2 | 4 | 6 | 8 | |
| Sulfur | 0.03 | 0.10 | 0.18 | 0.27 | 0.35 | |
| | Baader Test | | | | | VDE Specification (maximum) |
| Sap. No. (mg · KOH/g) | 8.8 | 3.7 | 0.8 | 0.05 | 0.10 | 0.6 |
| Sludge, wt % | 0.44 | 0.11 | 0.06 | 0.01 | 0.02 | 0.05 |
| Tan Δ at 90° C. (%) | 80 | 18 | 3.8 | 0.9 | 1.4 | 18 |

The impressive results of Tables VI and VII once again demonstrate the ability of the process of the invention to produce mineral oil compositions of outstanding high quality.

EXAMPLE 5 (COMPARATIVE)

The raffinate basestock A of Example 1 was hydrofined alone and with various proportions of the aromatic hydrocarbon fraction C in one hydrofining stage employing Catalyst X (Table I) over a range of hydrofining temperatures (and hence severities) in the range of from 270° to 310° C. so as to derive hydrofinate products having sulfur contents of 0.12 to 0.38 wt %. The hydrofinate products were evaluated for stability by the Baader Test, and the best result obtained was:

Saponification No.: 0.5 mg KOH/g

Sludge: 0.02 wt %

Tan Δ at 90° C.: 17%

This best result is only just within the maximum values of the VDE specification and is markedly inferior to compositions obtained by the process of the invention.

EXAMPLE 6

A raffinate F is obtained by solvent extraction of aromatics from a distillate of a paraffinic crude oil. The raffinate is dewaxed by methylethylketone solvent dewaxing to give a dewaxed raffinate G whose main characteristics are set out in Table VIII.

TABLE VIII

| | |
|---|---|
| Specific Gravity at 15° C. | 0.860 |
| Refractive Index at 75° C. | 1.455 |
| Aromatic Carbon, % (by IR) | 10.0 |
| Sulfur (wt %) | 1.3 |
| Pour Point (°C.) | −27 |

The raffinate G is subjected to a severe hydrofining step using the catalyst X of supported Ni-Mo under the following conditions: LHSV=0.75 $h^{-1}$; $H_2$ pressure=38 bars; $H_2$/Oil vol. ratio=110; temperature=335° C. and the resulting hydrofinate H has the following principal characteristics:

Aromatic Carbon, % (by I.R.): 9.8

Sulfur (wt %): 0.02

The hydrofinate H is blended with the hydrofinate D' in the range of proportions and the resulting composition is tested for stability by the Baader test. The results are given in Table IX.

TABLE IX

| | Composition, wt % | | | | |
|---|---|---|---|---|---|
| H | 100 | 98 | 96 | 94 | 92 |
| D' | 0 | 2 | 4 | 6 | 8 |
| | Baader Test | | | | |
| Sap. No. (mg KOH/g) | 8.0 | 2.7 | 0.62 | 0.16 | 0.15 |
| Sludge, wt % | 0.36 | 0.10 | 0.03 | 0.01 | 0.01 |
| Tan Δ at 90° C. (%) | 33 | 12 | 3.2 | 1.4 | 1.5 |

The data in Table IX once again attests the excellence of compositions made by the process of the invention.

EXAMPLE 7 (COMPARATIVE)

The raffinate G of Example 6 was hydrofined both alone and in a number of blends containing different proportions of the aromatic hydrocarbon fraction C using the catalyst X comprising supported Ni-Mo. The hydrofining was effected over a range of temperatures from 270° C. to 310° C. to produce hydrofined products having sulfur contents in the range of from 0.1 to 0.6 wt %.

The hydrofined products were evaluated by the Baader test, and the best result was as follows:

Saponification No.: 0.25 mg.KOH/g

Sludge: 0.025 wt %

Tan Δ at 90° C.: 6.5%

This best result is markedly inferior to the results obtained using products made by the process of the present invention, as demonstrated by the data of Example 6.

EXAMPLE 8

A paraffinic distillate I is hydrofined under severe conditions employing the Ni-Mo catalyst X, the conditions comprising:

LHSV: 0.7 $h^{-1}$ $H_2$ pressure: 35 bars $H_2$/Oil vol. ratio: 100

Temperature: 350° C.

The resulting hydrofinate J had an aromatic carbon content (by infra-red) of 25% and a sulfur content of 0.05 wt %.

The hydrofinate J alone was evaluated for oxidation stability and also in a blend of 94 wt % J+6 wt % C'. The evaluation was by the Baader test, and the results were as follows:

| | 100% J | 94% J + 6% C' |
|---|---|---|
| Saponification No. (mg. KOH/g) | 3.1 | 0.17 |
| Sludge (wt. %) | 0.02 | 0.01 |
| Tan Δ at 90° C. (%) | 13 | 2.5 |

The foregoing data again demonstrate the benefits realised by the application of the process of the invention.

I claim:

1. A process for producing a hydrocarbon oil composition of high resistance to oxidation comprising the steps of:

(a) subjecting a hydrocarbon oil basestock boiling in the lube oil temperature range and having an aniline point exceeding 60° C. to a catalytic hydrogen-refining treatment at a temperature in the range of from 300° to 360° C. and at a partial pressure of hydrogen in the range of from 20 to 50 bars to produce a refined basestock having a sulfur content not exceeding 0.10 wt. %;

(b) subjecting an aromatics-rich hydrocarbon fraction obtained by thermal or catalytic cracking of a heavy hydrocarbon feedstock, boiling in the lube oil temperature range and having an aniline point not exceeding 35° C. and a sulfur content of at least 2.0 wt. % to a catalytic hydrogen-refining treatment at a temperature in the range of from 220° to 300° C. and a partial pressure of hydrogen in the range of from 20 to 50 bars to produce a refined fraction having a sulfur content of at least 1.0 wt. %; and (c) forming a blend comprising 85 to 99.9 wt. % of the said refined basestock and 15 to 0.1 wt. % of said refined fraction.

2. A process according to claim 1 in which the hydrogen partial pressure in step (a) is in the range of from 30 to 40 bars.

3. A process according to claim 1 or claim 2 in which the catalytic hydrogen-refining treatment of step (a) is performed at a LHSV in the range of from 0.3 to 2.0 $h^{-1}$.

4. A process according to claim 3 in which step (a) is so effected as to produce a refined basestock having a sulfur content not exceeding 0.05 wt %.

5. A process according to claim 4 in which the hydrocarbon oil basestock has a specific gravity at 15° C. not exceeding 0.900.

6. A process according to claims 1 or 5 in which the mineral oil basestock is a raffinate obtained by solvent extraction of aromatics from a lube feedstock.

7. A process according to claim 6 in which the hydrogen partial pressure in step (b) is in the range of from 30 to 40 bars.

8. A process according to claim 7 in which the temperature in step (b) is in the range of from 240° to 280° C.

9. A process according to claim 8 in which the refined fraction produced by step (b) has a sulfur content of at least 2.0 wt %.

10. A process according to claim 9 in which the hydrocarbon fraction has a sulfur content of at least 3.5 wt % before step (b) is effected.

11. A process according to claim 9 in which step (b) is performed at a LHSV ($h^{-1}$) in the range of from 0.3 to 2.0 $h^{-1}$.

12. A process according to claim 6 in which the catalyst employed in step (a) and step (b) comprises a Group VI metal component and a non-noble Group VIII metal component.

* * * * *